US006663022B1

(12) United States Patent
Baker

(10) Patent No.: US 6,663,022 B1
(45) **Date of Patent: *Dec. 16, 2003**

(54) LOOPED TRIGGER LEVER GUARD ENCIRCLING GARDEN HOSE NOZZLE

(76) Inventor: John Baker, 11 Karol St., Bay Shore, NY (US) 11706

( * ) Notice: Subject to any disclaimer, the term of this patent is extended or adjusted under 35 U.S.C. 154(b) by 0 days.

This patent is subject to a terminal disclaimer.

(21) Appl. No.: 10/455,183

(22) Filed: Jun. 5, 2003

Related U.S. Application Data

(63) Continuation-in-part of application No. 10/294,438, filed on Nov. 14, 2002, now Pat. No. 6,575,387.

(51) Int. Cl.[7] ..... B05B 9/01; B05B 15/04

(52) U.S. Cl. ..... 239/525; 239/526; 239/288; 239/288.3; 239/288.5

(58) Field of Search ..... 239/525, 526, 239/288, 288.3, 288.5, 152, 154, DIG. 22; D23/214, 226, 227

(56) References Cited

U.S. PATENT DOCUMENTS

| | | | | | |
|---|---|---|---|---|---|
| 2,566,878 | A | | 9/1951 | Fahrenkrog | 15/406 |
| 3,944,141 | A | * | 3/1976 | Siczek | 239/288.5 |
| 4,210,181 | A | | 7/1980 | Clevenger | 141/392 |
| 4,257,460 | A | | 3/1981 | Paranay | 141/26 |
| 4,461,052 | A | | 7/1984 | Mostul | 15/29 |
| 4,541,568 | A | | 9/1985 | Lichfield | 239/441 |
| 4,811,765 | A | | 3/1989 | Gina | 141/392 |
| 5,052,587 | A | | 10/1991 | Graves | 222/79 |
| 5,160,092 | A | | 11/1992 | Rose et al. | |
| D338,209 | S | | 8/1993 | Butkoyich | D15/9.1 |
| 5,370,314 | A | * | 12/1994 | Gebauer et al. | 239/526 |
| 5,669,558 | A | | 9/1997 | Ichel | 239/311 |
| D412,965 | S | | 8/1999 | Kieffer | D23/226 |
| 6,000,637 | A | | 12/1999 | Duncan | 239/526 |
| 6,158,152 | A | | 12/2000 | Nathanson | 37/347 |
| 6,161,589 | A | | 12/2000 | Bolette | 138/106 |
| 6,305,619 | B1 | | 10/2001 | Thurn | 239/337 |
| 6,341,738 | B1 | | 1/2002 | Coles | 239/526 |
| 6,415,958 | B1 | | 7/2002 | Donley | 222/146.5 |
| 6,431,468 | B1 | | 8/2002 | Brown | 239/526 |
| 6,575,387 | B1 | * | 6/2003 | Baker | 239/525 |

FOREIGN PATENT DOCUMENTS

| | | | | |
|---|---|---|---|---|
| JP | 6190310 | | 7/1994 | B05B/9/01 |
| RU | 2069299 C1 | * | 11/1996 | F41C/3/04 |

* cited by examiner

*Primary Examiner*—Robin O. Evans
(74) *Attorney, Agent, or Firm*—Alfred M. Walker

(57) ABSTRACT

An anti-squirt ring acts as a handle guard for a palm operated garden hose nozzle lever. The guard is a circular ring, which obliquely surrounds the trigger lever of the garden hose nozzle. If the garden hose nozzle is accidentally dropped, the annular guard ring. The guard provides clearance if the trigger lever and nozzle are dropped. Therefore, the trigger lever will not forcefully contact the ground and be accidentally engaged, suddenly and erratically. The guard prevents unwanted spraying water from the nozzle in unwanted directions, such as at the user or at objects which should not get wet. The wire is configured in an annular ring and is either manufactured with the garden hose nozzle, or is attached by clamps, cable ties or hook and loop type fasteners.

23 Claims, 9 Drawing Sheets

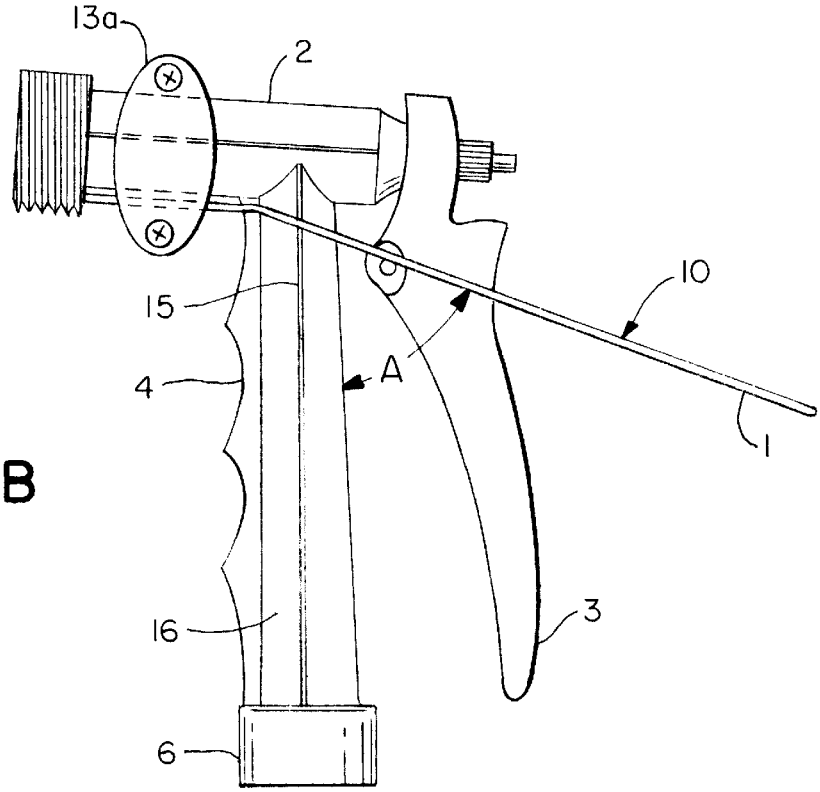
FIG. 3B
FIG. 8
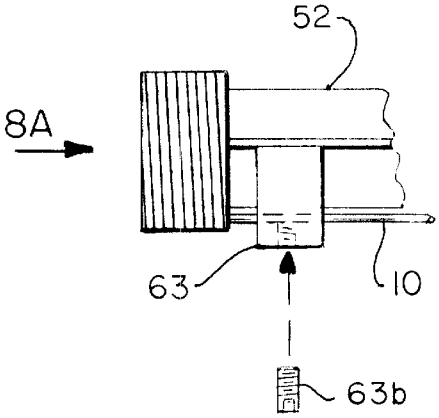
FIG. 8A
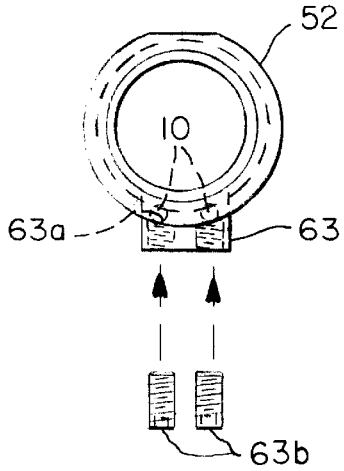

LOOPED TRIGGER LEVER GUARD ENCIRCLING GARDEN HOSE NOZZLE

RELATED APPLICATIONS

This application is based in part upon application Ser. No. 10/294,438, filed Nov. 14, 2002, now U.S. Pat. No. 6,575,387.

FIELD OF THE INVENTION

The present invention relates to trigger lever guards for garden hose nozzles operated by the whole palm of the user.

BACKGROUND OF THE INVENTION

Squeezing a trigger lever while using the palm of a closed fisted hand activates certain garden hose nozzles. However, these levers protrude outward from the nozzle pipe, and may be activated if the nozzle falls to the ground and the trigger lever hits the ground. That activation of the nozzle may cause spontaneous erratic discharge of water from the nozzle against the user or other objects which should not get wet.

Other nozzles have single finger-operated triggers, which can be protected by trigger guards, which extend around the finger operable trigger lever in a single plane parallel to the plane of the finger-operable trigger lever. However, these trigger guards cannot be used with the garden hose nozzles, which are used by squeezing a trigger lever, while using the palm of a closed fisted hand.

Among related patents for single plane trigger guards include U.S. Pat. No. 5,669,558 of Ichel, which discloses a pressure washer for use with garden hose 30 including trigger guard 34, as in FIG. 2 therein. However, the trigger guard in Ichel '558 is not an annular ring, but is rather a U-shaped guard in a single plane, parallel to the plane of the trigger lever. In other words, there's no protection from the sides, only from some obstruction in line with the plane of the trigger lever. In addition, the U-shaped guard of Ichel '558 cannot be used with a nozzle trigger handle lever, which is operated by the whole palm of the user.

Similar "single plane" trigger handle guards are shown in U.S. Design Pat. No. Des. 412,965 of Kieffer for a spray gun, as well as U.S. Pat. No. 6,431,468 of Brown for a foam dispensing nozzle, U.S. Pat. No. 6,415,958 of Donley for an adhesive dispensing nozzle, U.S. Pat. No. 6,341,738 of Coles for a power washer wand, U.S. Pat. No. 6,305,619 of Thurn for a tear gas nozzle, U.S. Pat. No. 6,158,152 of Nathansen for a pneumatic excavator, U.S. Pat. No. 6,000,637 of Duncan for a water gun, U.S. Pat. No. 5,052,587 of Graves for another water gun, U.S. Pat. No. 4,811,765 of Gina for a gasoline fuel pump nozzle, U.S. Pat. No. 4,541,568 of Lichfield for a car wash nozzle and U.S. Pat. No. 4,257,460 of Paranay for a water gun.

U.S. Pat. No. 4,461,052 of Mostul discloses a ring-type guard type body 102 attached to handle 14 and valve 22 of scrubbing brush 122, lever 26 and garden hose 12, as in FIG. 7 therein, but it covers a handle 104, like a hedge clipper handle, rather than protects the trigger lever 26.

U.S. Pat. No. 2,566,878 of Fahrenkrog discloses a guard 2 for a blower nozzle, as in FIGS. 1–3 therein, which protects the nozzle, but it does not cover the activator button.

U.S. Pat. No. 6,161,589 of Bolette discloses pipe hole covering 15 and sealing trim 27 which fits around a pipe 31, as in FIGS. 1,2 therein, but it is for a stationary pipe, not a movable garden hose nozzle.

U.S. Pat. No. Des. 338,209 of Butkoyich discloses a single plane guard for a gasoline fuel nozzle with an annular ring, but the ring is used to isolate gasoline vapors.

Other related U.S. Patents include U.S. Pat. No. 3,944,141 of Siczek, U.S. Pat. No. 5,160,092 of Rose et al, U.S. Pat. No. 5,370,314 of Duncan, and U.S. Pat. No. 4,210,181 of Clevenger.

Japanese Patent No. JP 6190310 discloses a handle guard in a single plane, like the aforementioned patents of Ichel '558 and the others noted above.

The aforementioned patents either do not protect a trigger lever of a nozzle, or they represent trigger guards operating in the operating plane of the trigger lever, which would interfere with normal operation of a palm operated nozzle trigger guard.

OBJECTS OF THE INVENTION

It is therefore an object of the present invention to provide a trigger lever guard, which protects a trigger lever of a palm operated garden hose nozzle.

It is also an object of the present invention to provide a trigger lever guard, which prevents the sudden, and erratic discharge of water from a palm operated garden hose nozzle if accidentally dropped on the ground.

Other objects which become apparent from the following description of the present invention.

SUMMARY OF THE INVENTION

In keeping with these objects and others, which may become apparent, the present invention is a trigger lever guard, which prevents accidental discharge of water from a garden hose nozzle, if it falls to the ground or hits another object.

As opposed to triggers operated by the user's fingers, which are typically protected by a trigger guard in the plane of the trigger, a garden hose nozzle is used by squeezing a lever using the palm of a hand. A trigger guard in the operating plane of the trigger lever interferes with normal operation.

In contrast, the trigger guard of the present invention comprises a geometric shaped object extending in at least one plane which intersects the plane of the pivot of a palm operable trigger lever of a garden hose nozzle. The geometrically shaped object may be a two dimensionally extending planar substrate extending in a single plane, which intersects the plane of the pivot of a palm operable trigger lever of a garden hose nozzle. Preferably, this single plane object is an annular ring. In other embodiments, the trigger guard may extend in more than one plane intersecting the plane of the pivot of the palm operable trigger lever, such as arcuately in a truncated domed trigger guard, having a complex curved surface and optional flat top. Also, the trigger lever guard may bear a shape of at least two planes extending at different angles from each other. For example, instead of a complex curved dome, the sides of the guard may extend in flat substrates, such as in a truncated pyramid shape.

In the preferred embodiment, the annular trigger lever guard of this invention is in the form of a rigid wire ring atop the trigger lever, thereby protecting the lever from accidental operation from side and back impact while affording access to the user's hand for normal unencumbered operation.

Although other embodiments may be applicable, two embodiments of the annular trigger lever guard are described. They are both wire forms, which have a large protective annular ring member and straight mounting elements bent at an angle.

While the preferred embodiment is simply bent and contains no welds, a second embodiment is also welded into a continuous loop to add more rigidity.

Three different mounting methods are described. The first is the use of one or more screw-mounted clamps, while the second method uses one or more plastic ratchet ties of the type commonly used for cable bundling, and the third method uses a one or more fabric straps using hook and loop attachments.

An injection molded plastic annular trigger lever guard similar in appearance to the welded wire embodiment is an alternative method of production.

In addition, the annular trigger guard of the present invention can be manufactured integral with the pipe of a garden hose nozzle.

An accessory planar substrate is shown attached to the annular ring portion of the annular ring of the lever guard. The attachment method uses adhesive, tape, or plastic straps wrapped around the edge of the annular ring. A substrate with a formed edge can also be designed to just snap over the annular ring for attachment. A graphic indicia, such as a product logo or design or commercial announcement, can be emblazoned upon a surface of the substrate extending within the confines of the annular ring. Due to the placement of the substrate, it does not interfere with normal operation of the garden hose nozzle.

In an alternate embodiment, a spring loaded one-piece trigger lever guard is provided for a palm operable trigger lever of a garden hose nozzle, which also prevents accidental discharge of water from a garden hose nozzle, if it falls to the ground or hits another object, thereby protecting the lever from accidental operation from side and back impact while affording access to the user's hand for normal unencumbered operation. This integral, spring loaded trigger guard includes a frame having a geometric shaped object extending atop the palm operable trigger lever of the garden hose nozzle in at least one plane which intersects a predetermined plane of pivot of said palm operable trigger lever. The spring loaded one-piece frame member has an annular ring extending atop said palm operable trigger lever of said garden hose nozzle in at least one plane which intersects a predetermined plane of pivot of the palm operable trigger lever. The annular ring is attached by a pair of parallel frame members each ending in an arcuate bend and returning approximately 180 degrees in an opposite direction, closely adjacent to a handle pipe of the garden hose nozzle. The trigger guard is mounted by spring loading action to a nozzle handle or spout of said garden hose nozzle. It is also mounted to the nozzle handle or spout of the garden hose nozzle such that the geometrically shaped object is positioned at an acute angle to an axis of a hose pipe portion of the nozzle.

Since the trigger lever guard of the present invention is a useful consumer-installed accessory of low cost, its value as a "give-away" promotional item for commercial advertising with the accessory substrate is apparent.

BRIEF DESCRIPTION OF THE DRAWINGS

The present invention can best be understood in connection with the accompanying drawings. It is noted that the invention is not limited to the precise embodiments shown in drawings, in which:

FIG. 3B is a side elevational view of a further alternate embodiment for an annular ring trigger guard, shown installed upon the spout of a garden hose nozzle with a screw clamp;

FIG. 8 is a close-up side detail view of a modified garden hose nozzle spout, including a built-in holder for a trigger lever guard;

FIG. 8A is a front end view thereof, taken along arrow "8A" of FIG. 8;

DETAILED DESCRIPTION OF THE INVENTION

Figure 1:
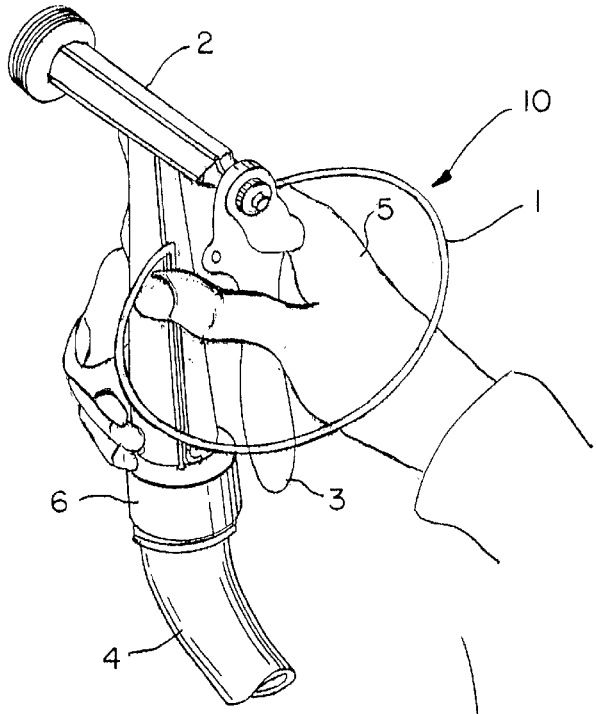
FIG. 1 is a perspective view of the annular trigger lever guard of this invention, shown mounted on a garden hose nozzle and in use.

FIG. 1 shows the preferred embodiment annular garden hose trigger lever guard 1 of this invention, mounted on a standard garden hose nozzle 2. Guard 1 permits user's hand 5 access under ring portion 10 for normal operation of trigger lever 3. Nozzle 2 is attached to hose 4 via coupling 6. In FIG. 1, trigger lever guard 1 can be permanently attached and manufactured integral with a garden hose nozzle. In other embodiments shown in FIGS. 3–7, the trigger guard is retrofitted to existing garden hose nozzles, and attached by clamps.

Figure 2:
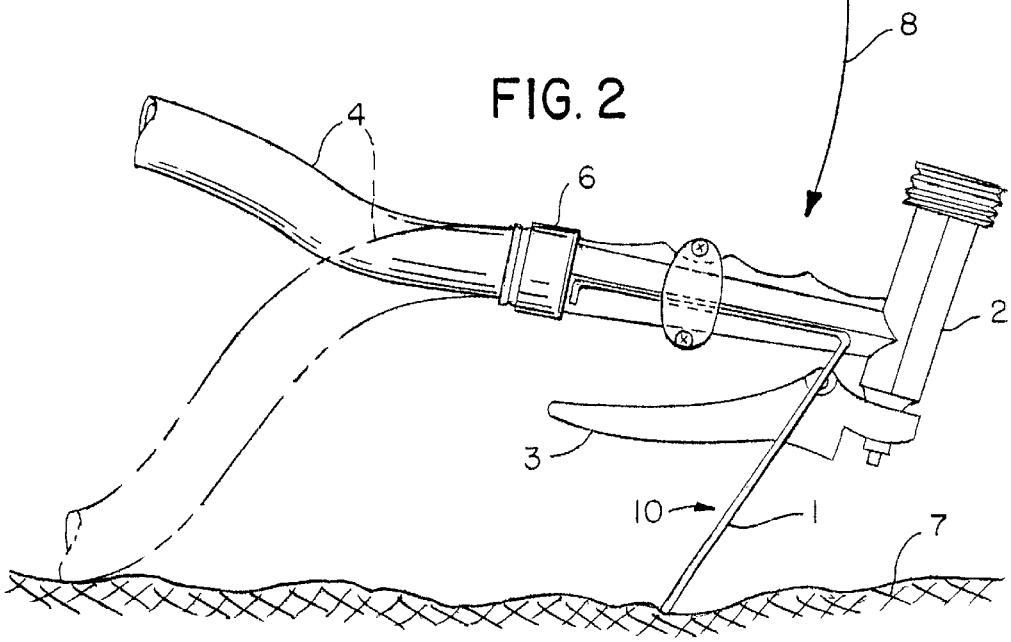
FIG. 2 is a side elevational view diagram, showing the trigger lever guard preventing accidental discharge at impact with the ground.

FIG. 2 shows operation of trigger lever guard 1 in preventing accidental discharge from a fall 8. Here ring 10 impacts ground 7, preventing forceful impact of lever 3, which would have produced an accidental discharge from garden hose nozzle 2. The position of hose 4 is immaterial to this protection. Also, if nozzle 2 is rotated counter-clockwise at impact, exposing handle 3 to potential impact with ground 7, the large bend radius of hose 4 protects handle 3 from forceful impact, thereby preventing accidental discharge of water therefrom. Ring 10 also protects lever 3 from oblique impacts with ground 7.

Preferably, ring 10 is set at an acute angle A (such as in a range of from about 45 degrees to about 90 degrees, preferably about 75 degrees) to the hollow pipe portion of the hose nozzle 2 attached to the hose at coupling 6. This orientation both protects the trigger lever from contact with the ground, and allows the user to have room to manipulate the trigger lever during use. For example, at angles greater than 90 degrees, there is more of a chance that the trigger lever will not be protected and will hit the ground unprotected. Also, at angles less than 45 degrees, there is not enough room to comfortably manipulate the trigger lever with the palm of the user's hand.

Figure 3:
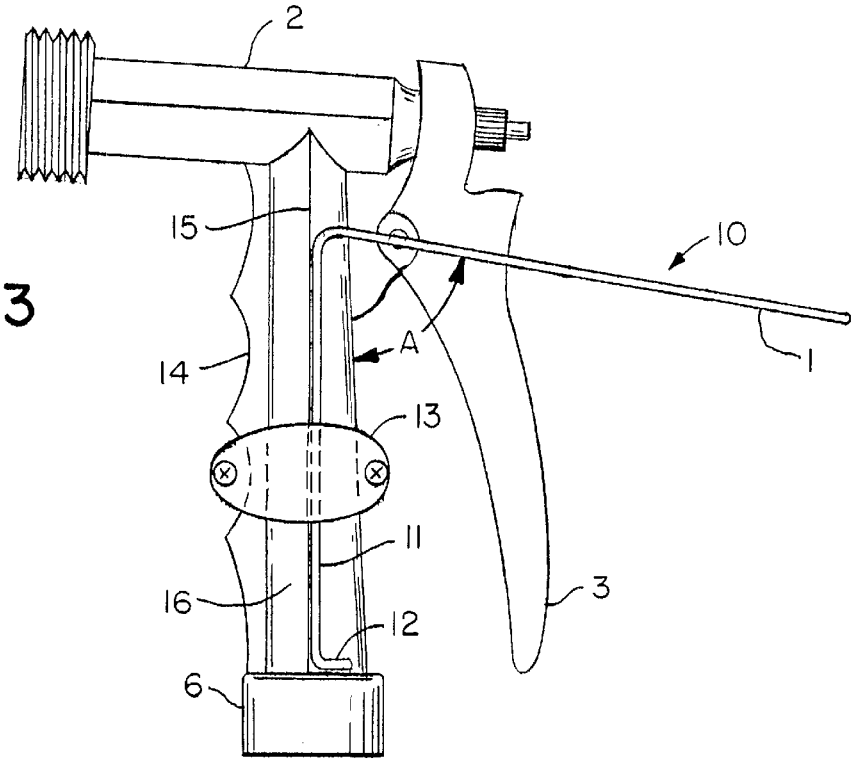
FIG. 3 is a side elevational view of an alternate embodiment for an annular ring trigger guard, shown installed on a garden hose nozzle with a screw clamp.

While the trigger lever guard can be permanently attached and manufactured integral with a garden hose nozzle, as in FIG. 1, FIG. 3 shows a preferred embodiment for attachment of annular trigger lever guard 1 to hollow nozzle pipe 16, to straight attachment members 11 with distal anti-rotation circular arc members 12. A plastic or metal screw clamp 13 is used for attachment in this illustration of FIG. 3. It has an internal recess that fits around hollow pipe 16 nozzle portion and finger grip 14. Attachment members 11 conveniently align with ridge 15, which is often an element of nozzle 2.

The preferred material of guard 1 is galvanized steel wire or painted, dip coated, or plastic sleeve covered steel wire. Ends 12 wrap partly around pipe 16 to resist members 11 from rotating torsionally. Alternatively, ends 12 can wrap entirely around pipe 16 in an alternate embodiment (not shown).

Figure 3A:
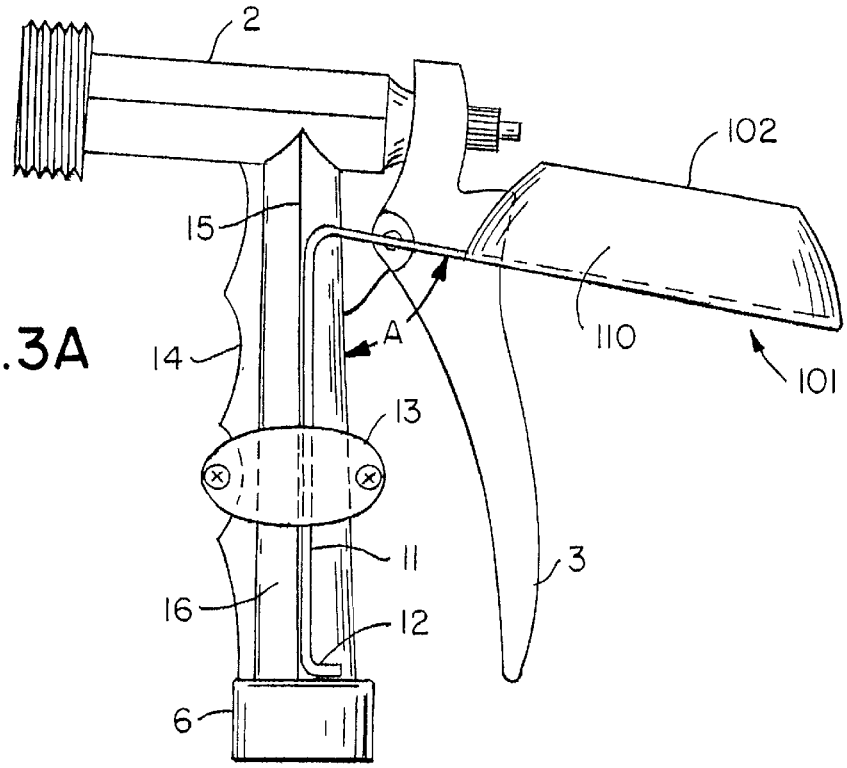
FIG. 3A is a side elevational view of another alternate embodiment for a truncated domed trigger guard, shown installed on a garden hose nozzle with a screw clamp.

FIG. 3A shows another alternate embodiment for a truncated domed trigger guard 101 having a complex curved surface 110 and optional flat top 102, shown installed on a garden hose nozzle.

FIG. 3B shows ring 10 and annular trigger lever guard 1 alternately attached by clamp 13*a* to a nozzle spout of garden hose nozzle 2. Ring 10 is also oriented at an acute angle A off of nozzle engaging pipe 16 of handle 4 of garden hose nozzle 2, of between about 45 degrees to about 90 degrees, preferable about 75 degrees.

Figure 4:
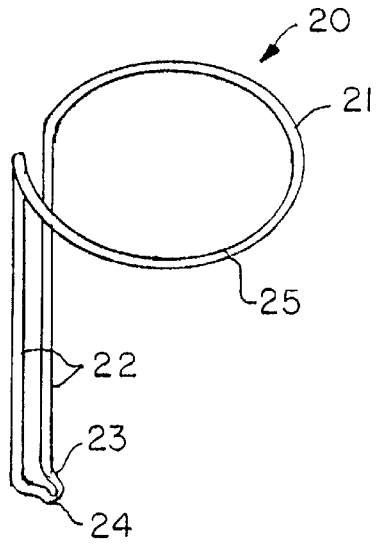
FIG. 4 is a perspective view of an alternate embodiment for an annular trigger lever guard, which is welded into a continuous loop.

FIG. 4 shows an alternate embodiment for a garden hose nozzle trigger lever guard 20, which differs from guard 1 in that it is welded into a complete loop structure after the bending operation. It is therefore more rigid, but it achieves this rigidity with the added welding operation. While weld 25 is shown at ring 21, it can be anywhere along the structure. Attachment members 22 may optionally end in a continuous circular arc 23 (almost a semicircle) with a small relief peak 24 in the center. The latter is to permit intimate positioning around pipe 16 of nozzle 2, which often has a molding seam at this position.

Figure 4A:
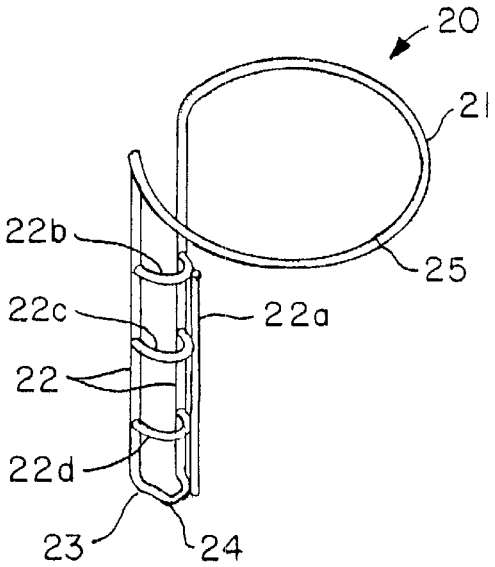
FIG. 4A is a perspective view of an alternate embodiment for an annular trigger lever guard, which is further protected by a brace.
Figure 4B:
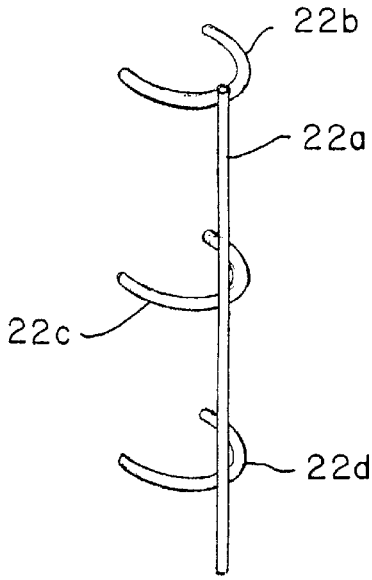
FIG. 4B is a perspective view of the brace as in FIG. 4A.

FIG. 4A shows an alternate embodiment for a longitudinally extending brace 22*a* to strengthen the position of attachment members 22 upon pipe 16 of the nozzle 2. FIG. 4B shows brace 22*a* with arcuate wings 22*b*, 22*c* and 22*d* which attach brace 22*a* to the attachment members 22 of trigger lever guard 20.

Figure 4C:
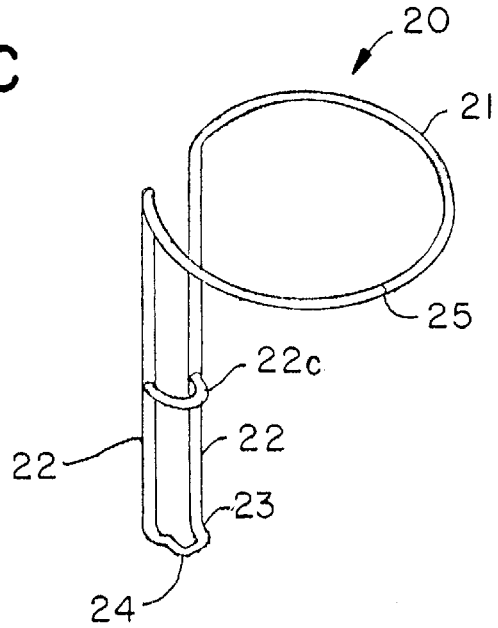
FIG. 4C is a perspective view of a further alternate embodiment for an annular trigger lever guard, which is further protected by a wing brace.

Alternatively, as shown in FIG. 4C, one or more wings 22*e* may act as braces for attachment members 22, without the need for longitudinally extending brace 22*a* shown in FIGS. 4A and 4B.

Figure 5:
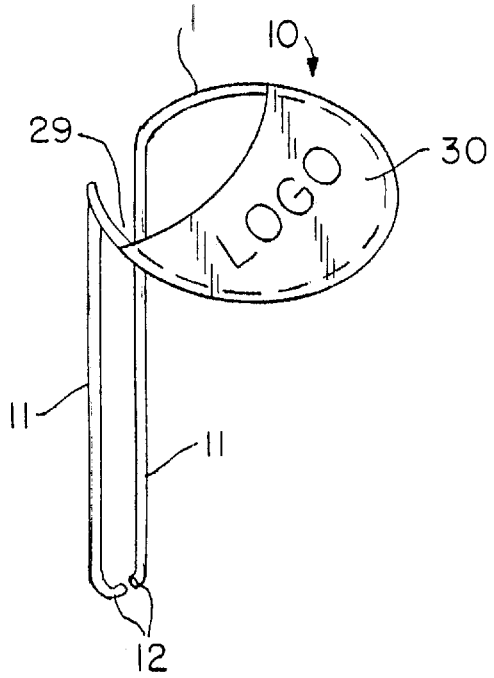
FIG. 5 is a perspective view of an accessory substrate installed on a ring portion of the trigger lever guard.

FIG. 5 shows accessory substrate 30, typically flat plastic semi-rigid material, attached to ring 10 at its edge. It has ample space for a logo or commercial message. Cutout 29 affords relief to permit unencumbered access for nozzle spray adjustment and unrestricted grasping of lever 3 and nozzle 2. Substrate 30 can be attached in the same manner to alternate embodiment guard 20. A logo can also be placed upon the surface 102 of truncated domed trigger lever guard 101 shown in FIG. 3A.

Figure 6:
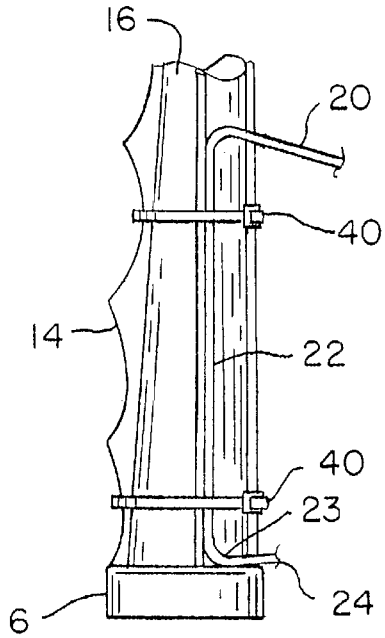
FIG. 6 is a side elevational view detail of an attachment method using plastic ratchet straps on an upright pipe portion of the garden hose nozzle; and, FIG. 7 is a side elevational view close-up detail view of an attachment method using hook and loop fabric straps.

FIG. 6 is a detail illustrating the attachment method using plastic ratchet straps 40 to attach alternate embodiment guard 20 to nozzle pipe 16.

Figure 7:
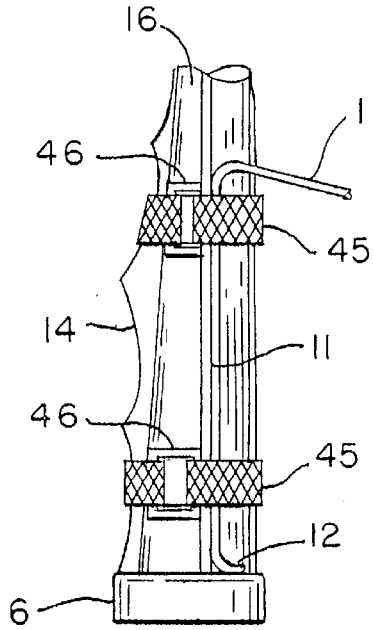
Figure 9:
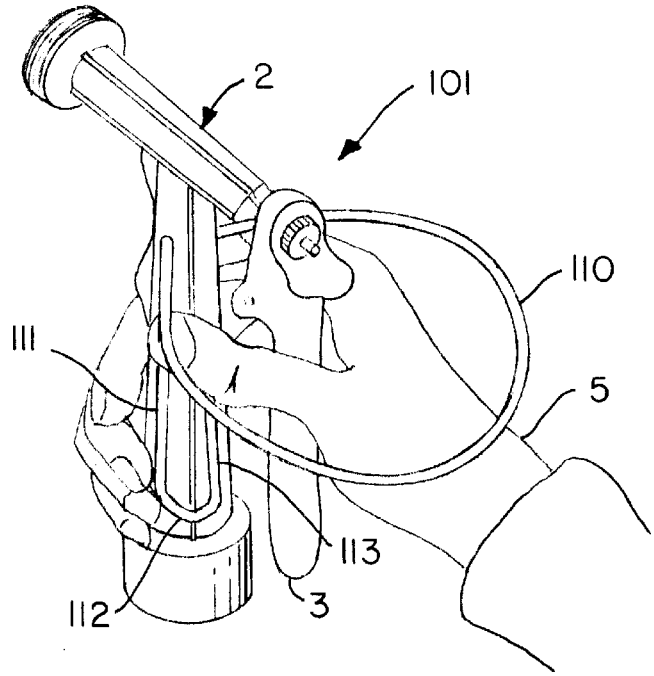
FIG. 9 is a perspective view of an alternate embodiment for an annular trigger lever guard of this invention, shown as an integral self adjusting trigger guard frame, mounted on a garden hose nozzle and in use.
Figure 10:
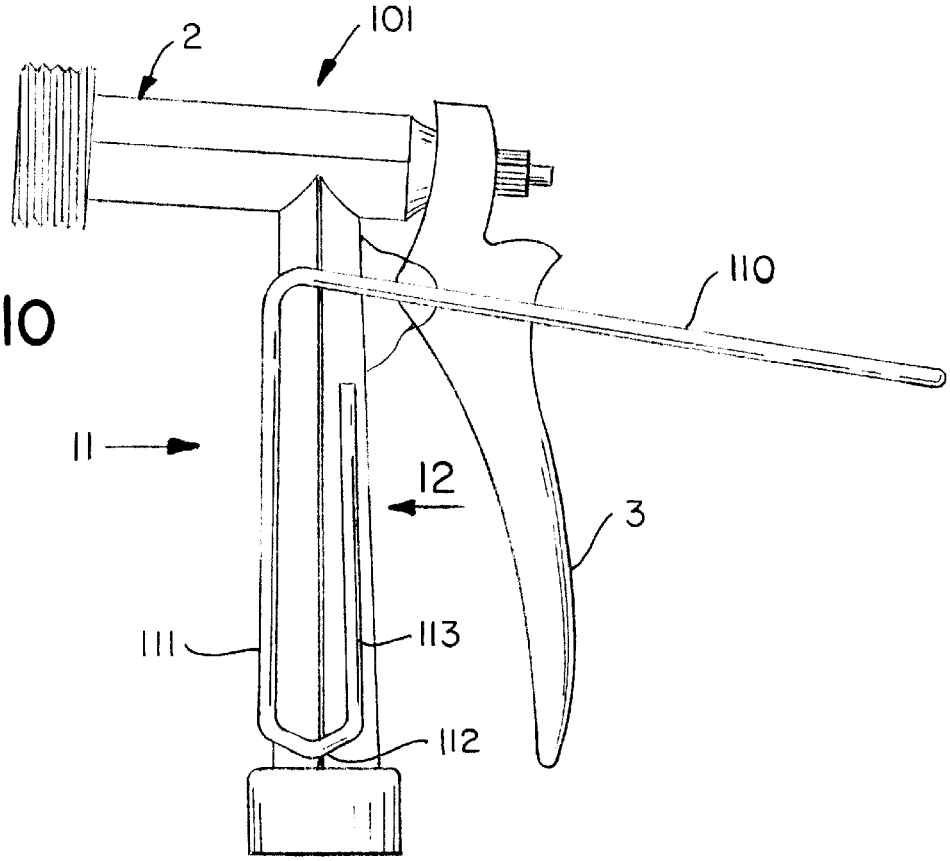
FIG. 10 is a side elevational view of the integral self adjusting trigger guard frame as in FIG. 9.
Figure 11:
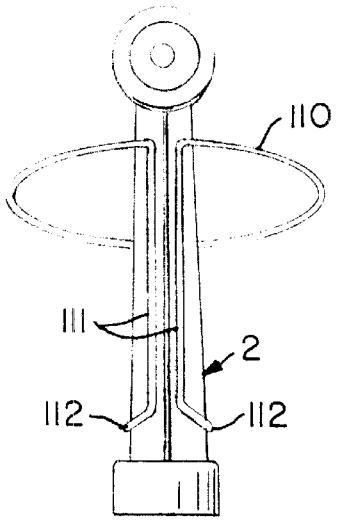
FIG. 11 is a front elevational view thereof, taken along arrow "11" of FIG. 10.
Figure 12:
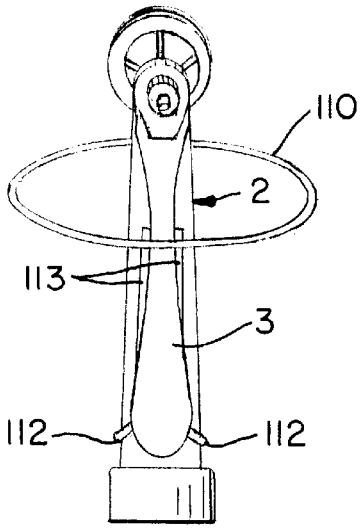
FIG. 12 is a rear elevational view thereof, taken along arrow "12" of FIG. 10; shown with a fastener clip.
Figure 13:
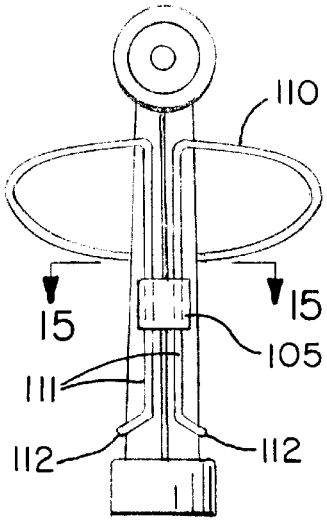
FIG. 13 is a front elevational view thereof as in FIG. 11, shown with a fastener clip.
Figure 14:
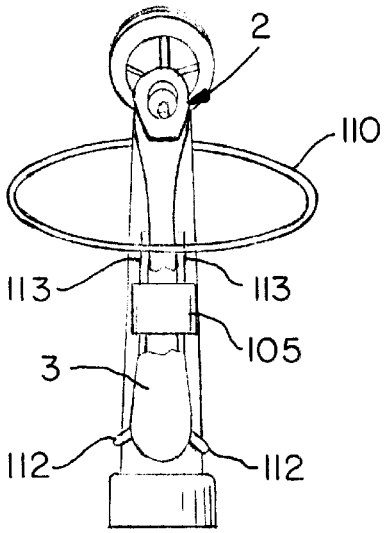
FIG. 14 is a rear elevational view thereof as in FIG. 12, shown with a fastener clip.
Figure 15:
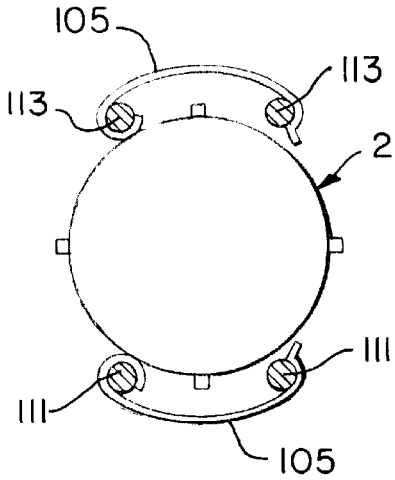
FIG. 15 is a top plan view in partial cross section taken along arrows "15—15" of FIG. 13; and, FIG. 16 is a perspective view of the trigger guard as in FIG. 9, shown upon an alternate non-ribbed handle portion of a nozzle
Figure 16:
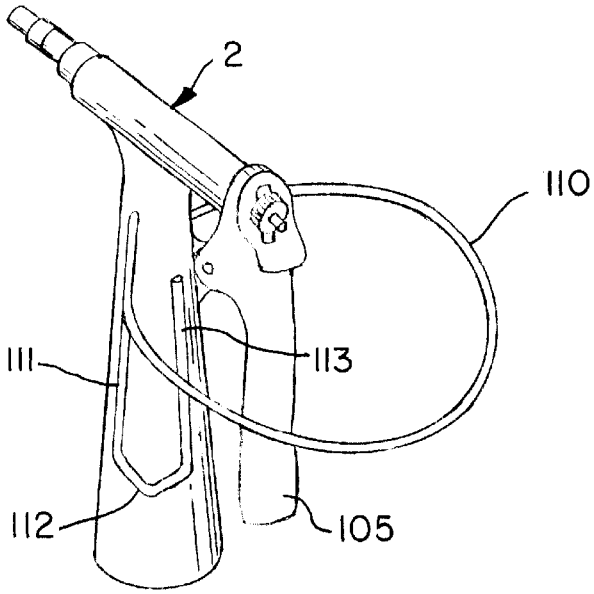

FIG. 7 is a detail showing the use of a pair of fabric straps 45 with buckles 46 and hook and loop fastener elements (not shown) to attach guard 1 to nozzle pipe 16.

FIGS. 8 and 8A show close-up detail views of spout 63*a* of garden hose nozzle 52, having a built-in cantilevered attachment member 63, accommodating the straight ends of ring guard 10 therethrough. A fastener 63, such as one or more set screws, tightens the ends of ring guard 10 therein.

It is further noted that any of the three attachment methods described can be used with either of the two embodiments of annular trigger lever guard, or that the trigger lever guard can be manufactured integral with a garden hose nozzle operated by the closed palm of the hand of the user.

FIGS. 9–16 shows an alternate embodiment for an integral, snap-on one piece annular garden hose trigger lever guard 101 of this invention, mounted on a standard garden hose nozzle 2. In FIGS. 9–16, integral trigger guard 101 includes annular guard ring portion 110 attached at respective ends of a small arcuate segment recess thereof to descending, approximately parallel straight attachment members 111, which in turn wrap around in further respective arcuate bends 112 and return 180 degrees in approximately parallel distal end frame members 113. Therefore handle pipe 114 of nozzle trigger guard 101 is held in place by the spring action of straight attachment members 111 and distal end frame members 113.

Guard 101 permits user's hand 5 access under ring portion 110 for normal operation of trigger lever 3. Nozzle 2 is attached to hose 4 via coupling 6, in a similar manner as shown in FIGS. 1 and 2.

In FIGS. 9–16, trigger lever guard 101 is a spring-loaded snap-on frame, which is removable. The one-piece bent nature of trigger guard 101 gives it a spring action, enabling it to fit snugly upon garden hose nozzle 2.

Alternatively, serpentine clips 105, which wrap around on of the rear frame members and against the other frame member, can further attach integral nozzle guard 101. In addition, attachment members shown in FIGS. 1–7 can alternatively attach trigger lever guard 101, such as by one or more screw-mounted clamps, cable ratchet ties or fabric straps having hook and loop attachments at opposite ends thereof.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A spring loaded one-piece trigger lever guard for a palm operable trigger lever of a garden hose nozzle, which prevents accidental discharge of water from a garden hose nozzle, if it falls to the ground or hits another object, thereby protecting the lever from accidental operation from side and back impact while affording access to the user's hand for normal unencumbered operation, said trigger guard comprising:

a frame having a geometric shaped object extending atop said palm operable trigger lever of said garden hose nozzle in at least one plane which intersects a predetermined plane of pivot of said palm operable trigger lever;

said frame being a spring loaded one-piece frame member; said geometric shape object extending atop said palm operable trigger lever of said garden hose nozzle in at least one plane which intersects a predetermined plane of pivot of said palm operable trigger lever;

said frame being mounted by spring loading action to a nozzle spout of said garden hose nozzle; and, said frame being mounted to said said garden hose nozzle such that said geometrically shaped object is positioned at an acute angle to an axis of a hose pipe portion of said nozzle.

2. The trigger lever guard as in claim 1 wherein said geometrically shaped object intersects said plane of said pivot of said palm operable trigger lever of the garden hose nozzle.

3. The trigger lever guard as in claim 1 wherein said geometrically shaped object extends in more than one plane intersecting said plane of said pivot of said palm operable trigger lever.

4. The trigger lever guard as in claim 3 wherein said geometrically shaped object extends arcuately in more than one plane intersecting said plane of said pivot of said palm operable trigger lever.

5. The trigger lever guard as in claim 2 wherein said geometrically shaped object is an annular ring.

6. The trigger lever guard as in claim 5 wherein said annular trigger lever guard is a rigid wire frame having said annular ring atop said trigger lever.

7. The trigger lever guard as in claim 1 wherein mounting angle of said geometrically shaped object to said pipe of said garden hose nozzle is at an angle between forty five degrees and ninety degrees.

8. The trigger lever guard as in claim 7 wherein mounting angle of said geometrically shaped object to said pipe of said garden hose nozzle is at an angle of about seventy five degrees.

9. The trigger lever guard as in claim 1 wherein said integral spring loaded trigger lever guard is further attached by an attachment clip.

10. The trigger lever guard as in claim 1 wherein said trigger lever guard is attached by at least one screw-mounted clamp.

11. The trigger lever guard as in claim 1 wherein said trigger lever guard is attached by at least one cable ratchet ties.

12. The trigger lever guard as in claim 1 wherein said trigger lever guard is attached by at least one fabric strap having hook and loop attachments at opposite ends thereof.

13. The trigger lever guard as in claim 1 wherein said trigger lever guard is an annular injection molded plastic trigger lever guard.

14. The trigger lever guard as in claim 1 wherein said trigger lever guard is molded integral with said nose nozzle.

15. The trigger lever guard as in claim 5 wherein said trigger lever guard is galvanized steel wire.

16. The trigger lever guard as in claim 5 wherein said trigger lever guard is painted steel wire.

17. The trigger lever guard as in claim 5 wherein said trigger lever guard is dip coated steel wire.

18. The trigger lever guard as in claim 5 wherein said trigger lever guard is plastic sleeve covered steel wire.

19. The trigger lever guard as in claim 5 wherein said annular ring includes respective distal ends which wrap partly around said nozzle pipe to resist torsional rotation of said trigger lever guard about said pipe.

20. The trigger lever guard as in claim 1 wherein said geometric shaped object further comprises a graphic indicia emblazoned upon a surface of a substrate attached by a formed edge to said geometrically shaped object.

21. An integral one-piece trigger lever guard for a palm operable trigger lever of a garden hose nozzle, which prevents accidental discharge of water from a garden hose nozzle, if it falls to the ground or hits another object, thereby protecting the lever from accidental operation from side and back impact while affording access to the user's hand for normal unencumbered operation, said trigger guard comprising:

a spring loaded one-piece frame member having an annular ring extending atop said palm operable trigger lever of said garden hose nozzle in at least one plane which intersects a predetermined plane of pivot of said palm operable trigger lever;

said annular ring attached by a pair of parallel frame members each ending in an arcuate bend and returning approximately 180 degrees in an opposite direction, closely adjacent to a handle pipe of the garden hose nozzle;

said annular ring mounted at an acute angle to a pipe of said garden hose nozzle.

22. A trigger lever guard for a palm operable trigger lever of a garden hose nozzle, which prevents accidental discharge of water from a garden hose nozzle if it falls to the ground or hits another object, thereby protecting the lever from accidental operation from side and back impact while affording access to the user's hand for normal unencumbered operation, said trigger guard comprising:

a one-piece frame member having an annular ring extending atop said palm operable trigger lever of said garden hose nozzle in at least one plane which intersects a predetermined plane of pivot of said palm operable trigger lever;

wherein said trigger guard is attached to a spout of said garden hose nozzle; and, said annular ring mounted at an acute angle to a pipe of said garden hose nozzle.

23. The trigger lever guard as in claim 22 wherein said frame is integral with said nozzle.

* * * * *